United States Patent [19]

Franklin

[11] 4,422,513

[45] Dec. 27, 1983

[54] GAS HYDRATES DRILLING PROCEDURE

[76] Inventor: Lindsay J. Franklin, Box 7, Site 26, R.R. #2, Calgary, Alberta, Canada, I2P 2G5

[21] Appl. No.: 280,346

[22] Filed: Jul. 6, 1981

[51] Int. Cl.[3] ..... E21B 21/00; E21B 21/06

[52] U.S. Cl. ..... 175/17; 175/66

[58] Field of Search ..... 175/17, 66, 48, 65; 166/DIG. 1

[56] References Cited

U.S. PATENT DOCUMENTS 3,303,895 2/1967 Fontenot ..... 175/66
3,498,393 3/1970 West et al. ..... 175/48
3,618,680 11/1971 Ellard ..... 175/17
3,701,388 10/1972 Warren ..... 175/48

*Primary Examiner*—Stephen J. Novosad

[57] ABSTRACT

When drilling through hydrate-containing strata, instead of increasing the density of the drilling mud to reduce or prevent melting of the hydrates, the density of the mud is maintained at a level sufficiently low to promote melting of the hydrates. The gas generated by the melting hydrates rises to the surface with the drilling mud which is diverted by a rotating diverter at the wellhead to a degasser where the gas is separated from the mud, and the mud is returned to the mud tanks for re-use. If the drill string is to be removed temporarily, the mud density is increased to stop hydrate melting.

4 Claims, 1 Drawing Figure

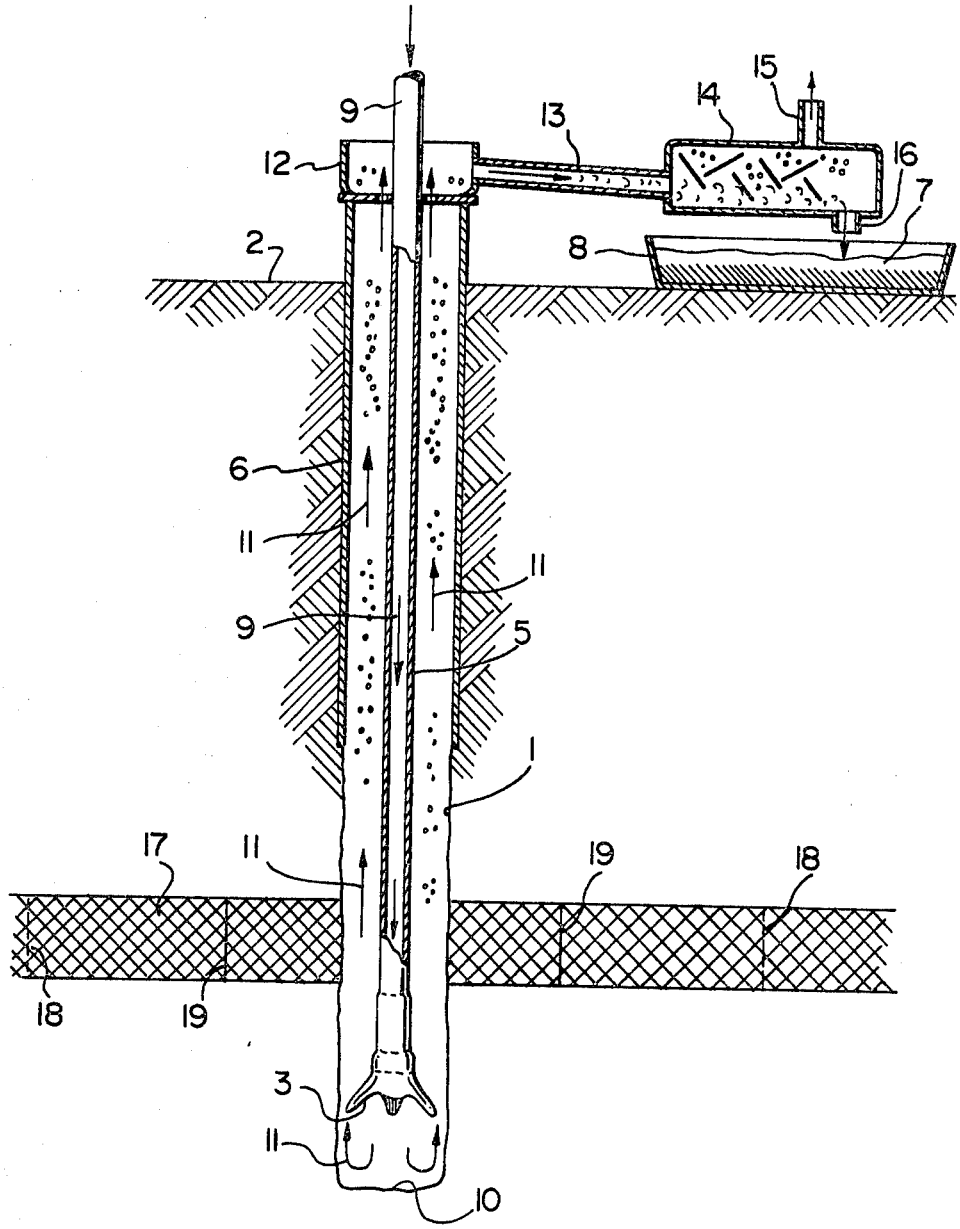
9
12
13
14
15
16
7
8
2
6
11
11
9
5
1
17
11
19
18
18
19
3
11
10

GAS HYDRATES DRILLING PROCEDURE

BACKGROUND OF THE INVENTION

This invention relates to a drilling method and apparatus, and in particular to a method and apparatus for drilling through a stratum containing gas hydrates.

The hydrates of hydrocarbon gases have long presented serious problems in the drilling of oil or gas wells. Recently, naturally occurring gas hydrates have been found in polar drilling and in wells drilled under very deep water in temperate or equatorial regions. When such naturally occurring hydrates are encountered and drilling proceeds deeper, the hydrate bearing section may be exposed to increased temperature which causes melting and consequently gas is introduced to the mud column normally used to clean the hole of cuttings and for lubricating the drill bit. The presence of gas in the mud column reduces hydrostatic pressure at the hydrate bearing interval which causes additional melting of hydrates in the vicinity of the hole. The reduction in hydrostatic pressure of the mud column tends to create a condition in which any free gas exposed to the hole will enter the hole. When such a condition occurs, the usual procedure is to take the routine steps for preventing a blowout, i.e., the blowout preventer is closed, gas is circulated out of the system, and the mud density is increased to a level intended to inhibit the flow of additional gas into the hole.

The varying of drilling mud density according to the quantity of gas encountered during drilling is discussed fully, for example, in U.S. Pat. No. 3,498,393, which issued to A. G. West et al on Mar. 3, 1970. The West et al solution to the problem of increased gas production is to continuously monitor the flow rate of gas separated from the drilling fluid (mud), and to adjust the density of the drilling fluid accordingly. When gas pressure increases, the density of the mud is increased and vice versa. U.S. Pat. No. 3,701,388, which issued to J. N. Warren on Oct. 31, 1972, proposes essentially the same solution to the problem of increased gas in the drilling mud. Warren also teaches the use of a temperature detecting method to determine the nature of the formation being drilled.

The present inventor has effected a detailed study of drilling in hydrate-containing strata. An examination of the hydrate pressure/temperature relationship reveals that increased mud density can provide temporary relief from the melting of hydrates, but high pressures are rapidly generated by relatively small increases in temperature. Higher mud density is not a viable method of permanently stopping hydrate melting. Another solution to the gas inflow problem is the cooling of the mud to the lowest possible temperature while increasing mud density. The success of the procedure has not been remarkable. Problems continue to plague the driller, often creating a requirement for multiple casing strings and thus increased expense.

The object of the present invention is to at least partially solve the problem of dealing with naturally occurring hydrates by providing a simple drilling method which facilitates the drilling through a hydrate-containing stratum.

SUMMARY OF THE INVENTION

Accordingly, the present invention relates to a method of drilling in hydrate-containing stratum comprising the steps of:

(a) forming a wellbore by drilling into the hydrate-containing stratum;

(b) continuously feeding a drilling mud into said wellbore;

(c) maintaining the density of said mud at a level sufficiently low to promote the melting of hydrates; and (d) continuously discharging the mud/gas mixture thus produced from the wellbore as quickly as the mixture is produced.

BRIEF DESCRIPTION OF THE DRAWINGS

The invention will now be described in greater detail with reference to the accompanying drawing, which is a schematic, longitudinal sectional view of a wellbore in which the method of the present invention is performed.

DESCRIPTION OF THE PREFERRED EMBODIMENT(S)

The method of the invention is used in drilling a wellbore 1 into the earth from the surface 2 using a rotary drill bit 3 mounted on the bottom end 4 of a drill string 5. The drill bit 3 and the string 5 are rotated by a suitable source of power (not shown) connected to the top end of the string 5. At least the upper end of the wellbore 1 is protected by a casing 6.

Conventional drilling mud 7 is pumped from a tank 8 downwardly through the drill string 5 as indicated by arrows 9 to bottom 10 of the wellbore 1. The mud passes around the drill bit 3 lubricating the latter and returns to the surface in the direction of arrows 11. The returning mud passes through a rotating diverter 12 at the wellhead and through a pipe 13 to a degasser 14. The diverter 12 is merely a rubber packing gland immediately below the rotary table (not shown).

The mud and gas mixture fed into the degasser 14 is separated, i.e., the gas is separated from the mud and vented to the atmosphere via an outlet duct 15. The mud is discharged from the degasser 14 via an outlet duct 16 to the tank 8. There are normally a plurality of mud tanks. The mud may be cooled using heat exchangers (not shown) in the mud tanks. Cooling of the mud is effected if it is believed that such action would optimize the rate of drilling.

Thus, it is seen that the rate of penetration through a hydrate bearing stratum or section 17 is dependent on the capability of the degasser 14 or degassers to separate the gas being generated in the well. When it becomes necessary to remove the drill string 5 from the wellbore 1 (i.e., to change the bit, log, run casing or to deal with mechanical problems), the density of mud fed into the wellbore 1 is increased to exert an increased pressure on the hydrate section 17. When drilling at a low pressure, the hydrate melt front 18 is at a greater distance from the wellbore 1 than the front 19 when drilling at a higher pressure. In other words, by increasing the pressure in the wellbore, the hydrate containing section 17 is stabilized at a location closer to the wellbore 1 than at a lower pressure.

The drill hole or wellbore 1 with the mud circulating at a temperature greater than the formation temperature is a heat source. The formation or section surrounding the drill hole is characterized by a series of isotherms migrating radially from the wellbore in a manner predictable from the history of the heat input, i.e., the temperature decreases radially outwardly from the wellbore in a known manner. When a decision is made to remove the drill string 5 from the hole 1, the history of heat input into the hole and the pressure at the bottom 10 of the hole are known. It is then possible to calculate (i) the diameter of the zone in which hydrate melt has been induced; (ii) the diameter of the hydrate equilibrium isotherm which will exist under increased or decreased pressure at the bottom of the hole; and (iii) the time required for the isotherm referred to in (ii) to migrate outwardly to the diameter referred to in (i).

Thus, the pressure at the bottom 10 of the wellbore 1 can be increased to the level required for drilling interruption of sufficient duration to permit removal and replacement of the drill string.

Thus, there has been described a method in which the melting of hydrates is intentionally promoted by the use of low density drilling mud, the gas-containing mud is passed through a degasser at the surface, and higher density mud is pumped into the wellbore when the drill string is to be removed. Suitable computer programs are being developed to enable accurate determinations of the pressure increase required to interrupt hydrate melting for specific periods of time.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A method of drilling in a hydrate-containing stratum comprising the steps of:

(a) forming a wellbore by drilling into the hydrate-containing stratum;

(b) continuously feeding a drilling mud into said wellbore;

(c) maintaining the density of said mud at a level sufficiently low to promote the melting of hydrates; and (d) continuously discharging the mud/gas mixture thus produced from the wellbore as quickly as the mixture is produced.

2. A method according to claim 1, wherein said drilling mud is cooled prior to being fed into the wellbore.

3. A method according to claim 1 or 2, wherein said mud/gas mixture is diverted at the wellhead to a degasser; the mud and gas are separated; the gas is vented to the atmosphere; and degassed mud is returned to the wellbore.

4. A method according to claim 1 or 2, wherein the melting of hydrates in the vicinity of the wellbore is temporarily interrupted by the application of increased hydrostatic pressure through the introduction of higher density mud to the wellbore; the degree of increase in mud density being dependent upon the length of hydrate melting interruption required.

* * * * *